US005836777A

United States Patent [19]

Chen

[11] Patent Number: 5,836,777

[45] Date of Patent: Nov. 17, 1998

[54] ELECTRICAL OUTLET DEVICE FOR CONNECTION WITH VARIOUS TYPES OF PLUGS

[75] Inventor: David Chien Hua Chen, Taipei, Taiwan

[73] Assignee: Board-Tech Electronic Co., Ltd., Taipei, Taiwan

[21] Appl. No.: 778,673

[22] Filed: Jan. 3, 1997

[30] Foreign Application Priority Data

Apr. 27, 1996 [TW] Taiwan ..... 85206144

[51] Int. Cl.[6] ..... H01R 27/00

[52] U.S. Cl. ..... 439/222; 439/956

[58] Field of Search ..... 439/218, 221, 439/222, 956

[56] References Cited

U.S. PATENT DOCUMENTS 4,033,658 7/1977 Astek ..... 439/218
4,518,212 5/1985 Rumble ..... 439/221
5,007,848 4/1991 Lee ..... 439/222

*Primary Examiner*—Neil Abrams
*Assistant Examiner*—Barry M. L. Standig
*Attorney, Agent, or Firm*—Beveridge, DeGrandi, Weilacher & Young, L.L.P.

[57] ABSTRACT

An electrical outlet device includes a base casing; a cover covering the base casing; a grounding conductive assembled including a base frame formed with at least a first clamping portion having a pair of elastic pieces, a second clamping portion having a pair of elastic pieces, and a third clamping portion having a pair of elastic pieces thereon; and a first contact conductive assembly and a second contact conductive assembly, each including a rib-like clamping portion composed of a pair of elastic pieces and a screen elastic piece. In this electrical outlet device, the elastic pieces of the first and third clamping portions of the grounding conductive assembly each have a top edge formed with a notch; and the elastic pieces of the rib-like clamping portion on the first and second contact conductive assemblies each has a top edge formed with a notch, the screen elastic piece being bent away from the rib-like clamping portion.

12 Claims, 5 Drawing Sheets

ELECTRICAL OUTLET DEVICE FOR CONNECTION WITH VARIOUS TYPES OF PLUGS

BACKGROUND OF THE INVENTION

1. Field of the Invention

This invention relates to electrical outlet devices, and more particularly, to an electrical outlet device for connection with various types of plugs having round pins or flat pins.

2. Description of Related Art

An electrical outlet device (commonly called socket or receptacle) is a contact device for connection with a plug that then transfers the output electricity via a flexible cord to various electrical appliances. In different countries, since the specifications of utility power are varied, the specifications of receptacles and plugs are also different. As a consequence of this, a person traveling to a different country may find, for example, the plug on his automatic shaver unmatched to the receptacles in that country. One solution is to change the plug to a matching type, or use an adapter which connects between the unmatching plug and receptacle. But neither way is convenient.

A conventional type of receptacle which allows for connection with various types of plugs is shown in FIG. 1. This receptacle includes a cover 1' having an opening 10' (which includes two adjoining circular through holes) formed therein. This opening 10' is used to allow a grounding plug pin of a plug to pass therethrough. Further, the cover 1' is formed with a first hole 11', a second hole 12', and a pair of substantially T-shaped slots 13' consisting of a lengthwise part 130' and a crosswise part 132'.

The receptacle further includes a base casing 2' whose inside is divided by separators 200', 202' into two contact compartments 21', 22' and one ground compartment 23'. The ground compartment 23' is used to house a curved grounding conductive piece 3' which includes a first contact pair 31', a second contact pair 32', and a third contact pair 33' on the top. The contact compartments 21', 22' are used to respectively to house a first contact conductive piece 4' and a second contact conductive piece 5'. These two conductive pieces 4', 5' are shaped symmetrically, including substantially U-shaped frames 40', 50', reception conductive pieces 41', 51', and substantially L-shaped conductive pieces 42', 52'.

The foregoing receptacle can be used for connection with various types of plugs. However, there are still several disadvantages. For example, when used for connection with plugs having large round plug pins, such as those used in Germany and South Africa, or plugs having wide flat plug pins, such as those used in Great Britain, these large-size plug pins will cause the two opposing parts 400', 402' and 500', 502' of the U-shaped frames 40'. 50' to be urged wide open. By contrast, the plugs used in Italy and Switzerland have smaller sized plug pins that will urge the same to be less wide open. When the plugs having large-size plug pins are used frequently, the U-shaped frames 40', 50' would be subjected to elastic fatigue. If the same receptacle is used for connection with the plugs having small-size plug pins, the fatigued U-shaped frames 40', 50' might not be able to hold the plugs securely in position. Electrical contact effect will also be poor, and the plug might easily get loosened away from the receptacle.

Furthermore, when the receptacle is used for connection with Australian type plugs having slanted flat plug pins, the plus pins will come in contact with the U-shaped frames 40', 50' and the substantially L-shaped conductive pieces 42', 52'. Since the substantially L-shaped conductive pieces 42', 52' and the opposing parts 400', 402' and 500', 502' of the U-shaped frames 40', 50' are arranged substantially in perpendicular with respect, to each other, this usually causes the parts 402' and 502' of the U-shaped frames 40', 50' to be urged away from the other parts 400' and 500' of the same when the plug is inserted in position in the receptacle. This might cause weakening to the U-shaped frames 40', 50'. Electrical contact effect will thus be poor, and the plug might easily get loosened away from the receptacle. Moreover, the substantially L-shaped conductive pieces 42', 52' and the opposing parts 400', 402' and 500', 502' of the U-shaped frames 40', 50' are not configured in such a way suitable for connection with Australian type plugs having slanted flat plug pins. The insertion is usually not very smooth.

One further drawback to the receptacle of FIG. 1 is that, since the contact conductive pieces 4', 5' are symmetrically formed, they should be manufactured respectively. Two different parts are thus provided for assembly. This causes inconvenience not only in assembly but also in component control. Furthermore, when the receptacle is used for connection with a plug having round plug pins, the plug pins might only come in parallel with but not in tight electrical contact with the opposing parts 400', 402' and 500', 502' of the U-shaped frames 40', 50' and the third contact pair 33' on the grounding conductive piece 3' since these parts are all flat-piece structures. Therefore, in the event of fatigue to these parts, electrical contact effect will not be assured. There exists, therefore, a need for an improvement on the receptacle.

SUMMARY OF THE INVENTION

It is therefore a primary objective of the present invention to provide an electrical outlet device for connection with various types of plugs whose electrical contact effect will not be degraded due to frequent connection with plugs of various plug pins.

It is another objective of the present invention to provide an electrical outlet device which can be used for connection with various types of plugs smoothly.

It is still another objective of the present invention to provide an electrical outlet device for connection with various types of plugs in which only one model of contact conductive piece is provided such that assembly and component control are both convenient to carry out.

In accordance with the foregoing and other objectives of the present invention, a new improved electrical outlet device for connection with various types of plugs is provided. The electrical outlet device includes a base casing; a cover covering the base casing; a grounding conductive assembly including a base frame formed with at least a first clamping portion, a second clamping portion, and a third clamping portion thereon; and a first contact conductive assembly and a second contact conductive assembly, each including a rib-like clamping portion composed of a pair of elastic pieces and a screen elastic piece.

In this electrical outlet device, the elastic pieces of the first and third clamping portions of the grounding conductive assembly each have a top edge formed with a notch; and each elastic piece of the first and third clamping portions of the grounding conductive assembly is bent toward each other into a curved shape. The elastic pieces of the rib-like clamping portion on the first and second contact conductive assemblies each have a top edge formed with a notch, and each elastic piece of the rib-like clamping portion of the first and second conductive assemblies is also bent toward each other into a curved shape; further, the screen elastic piece of the first and second contact conductive assemblies each has a top edge formed with at least two notches, and two side portions of each screen elastic piece formed between the notch and the side edge of each screen elastic piece are bent away from the rib-like clamping portion with respect to the vertical axis of the plane of each screen elastic piece.

The cover is formed with a substantially T-shaped opening, in which a first ground slot, a second ground slot, and a third ground slot, and a pair of receptacle slots positioned symmetrically about the third ground slot are formed. The first ground slot includes a first portion which is substantially circular in shape, a second portion which is also substantially circular in shape, a third portion which connects the first and second portions, and a fourth portion which is substantially rectangular in shape. The second ground slot and the third ground slot are both circular in shape. These three slots can receive plugs having round and flat plug pins. Further, the receptacle slots each includes a first portion which is basically circular in shape, a second portion which is rectangular in shape and connected to one side of the first portion, a third portion connected in a slanted direction to the second portion, and a fourth portion which is also rectangular in shape and formed on the other side of the first portion. Among these portions, the third portion is specifically used to receive plugs having slanted flat plug pins.

The base casing has its inside divided by separating plates into several compartments including a ground compartment, a first contact compartment, and a second contact compartment. The ground compartment is used to house the grounding conductive assembly, the first contact compartment is used to house the first contact conductive assembly, and the second contact compartment is used to house the second contact conductive assembly. Further, the bottom wall of the base casing is formed with three screw holes that allow screws to be fastened therethrough to electrically connect the grounding conductive assembly and first and second contact conductive assemblies to connecting wires. Also, this allows an adapter to be attached to the bottom of the base casing, which is connected via conductive pads to the grounding conductive assembly and first and second contact conductive assemblies.

In addition, the electrical outlet device of the invention can be used as an extension cord unit having a plurality of receptacles.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENT

Figure 1:
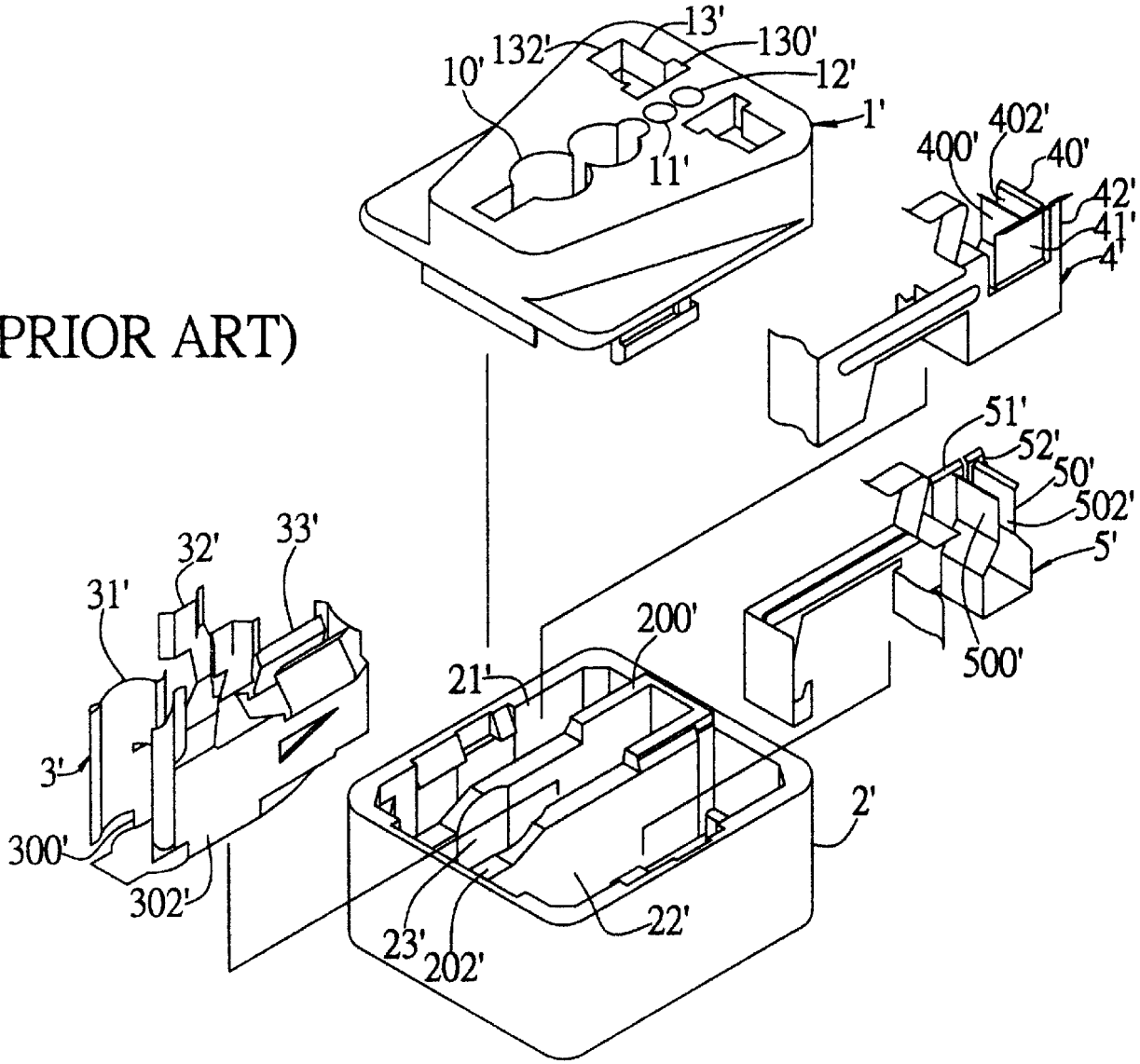
FIG. 1 (PRIOR ART)
FIG. 1 is an exploded perspective view of a conventional electrical outlet device for connection with various types of plugs.
Figure 2:
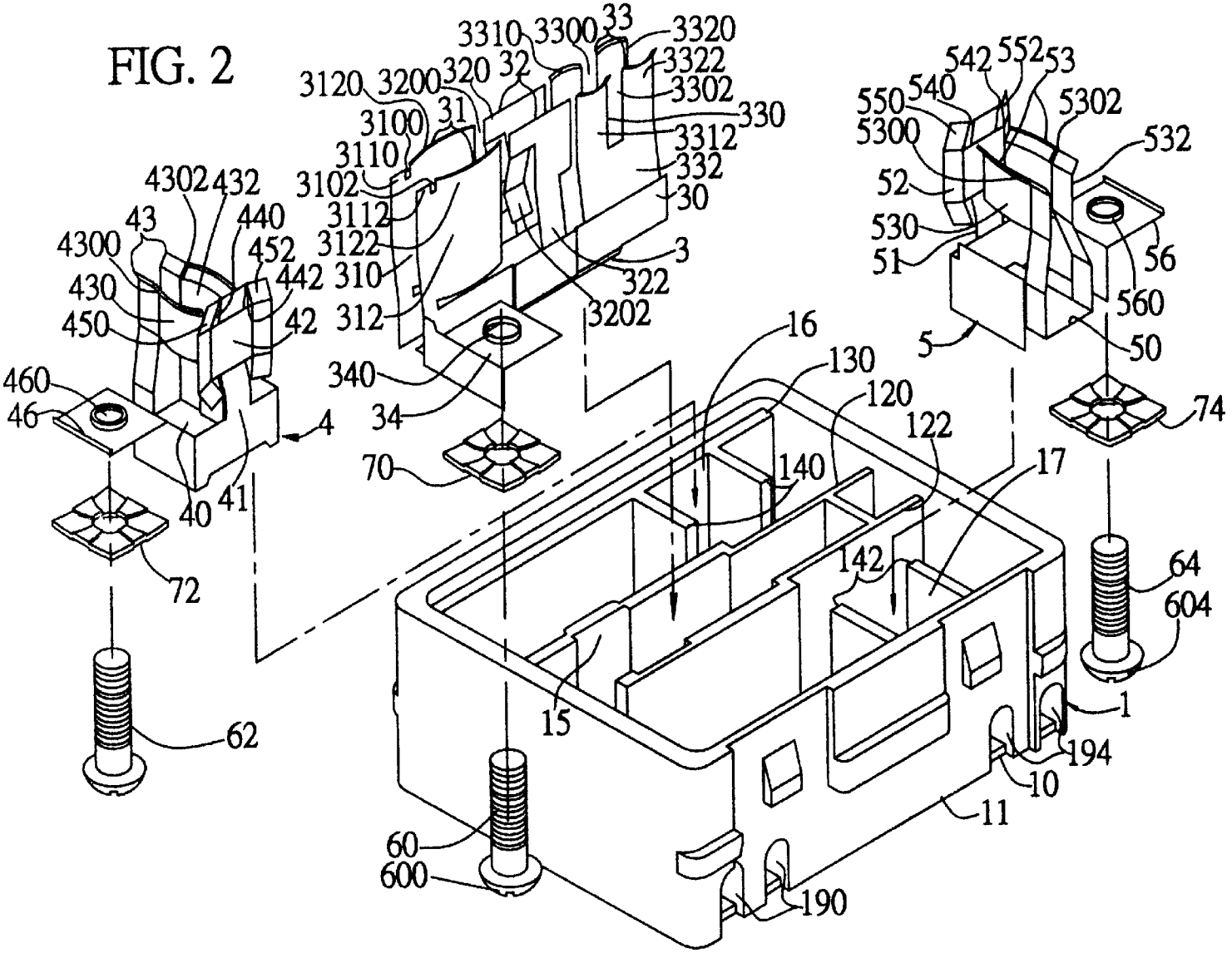
FIG. 2 is an exploded perspective view of the electrical outlet device for connection with various types of plugs according to the present invention.
Figure 4:
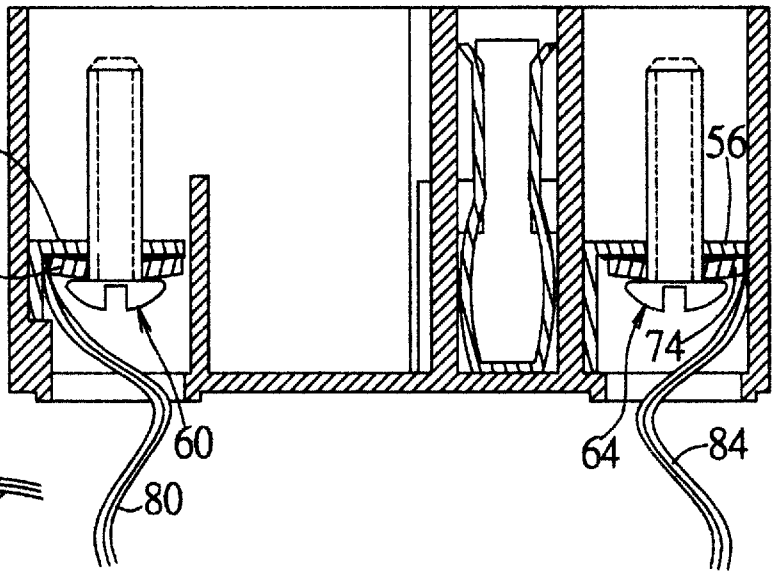
FIG. 4 shows a sectional view of the device of FIG. 3 cutting through the line A—A.
Figure 3:
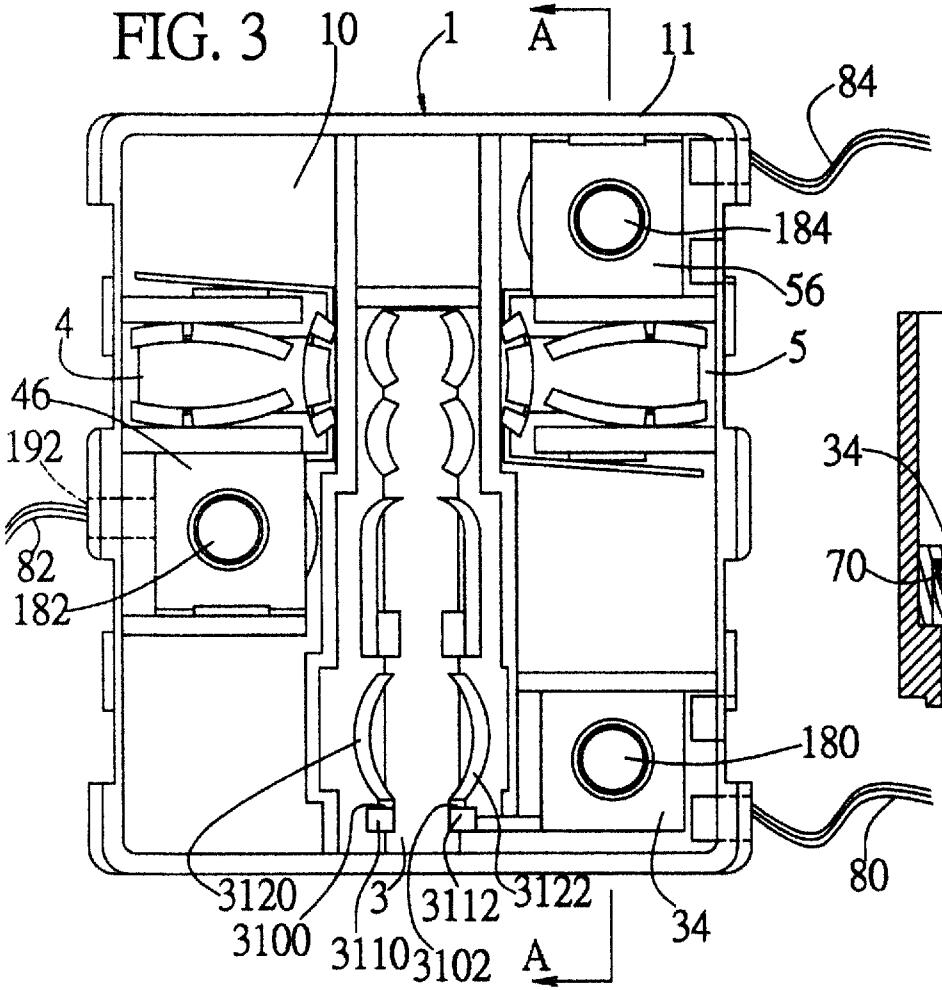
FIG. 3 is a bottom view.
Figure 5:
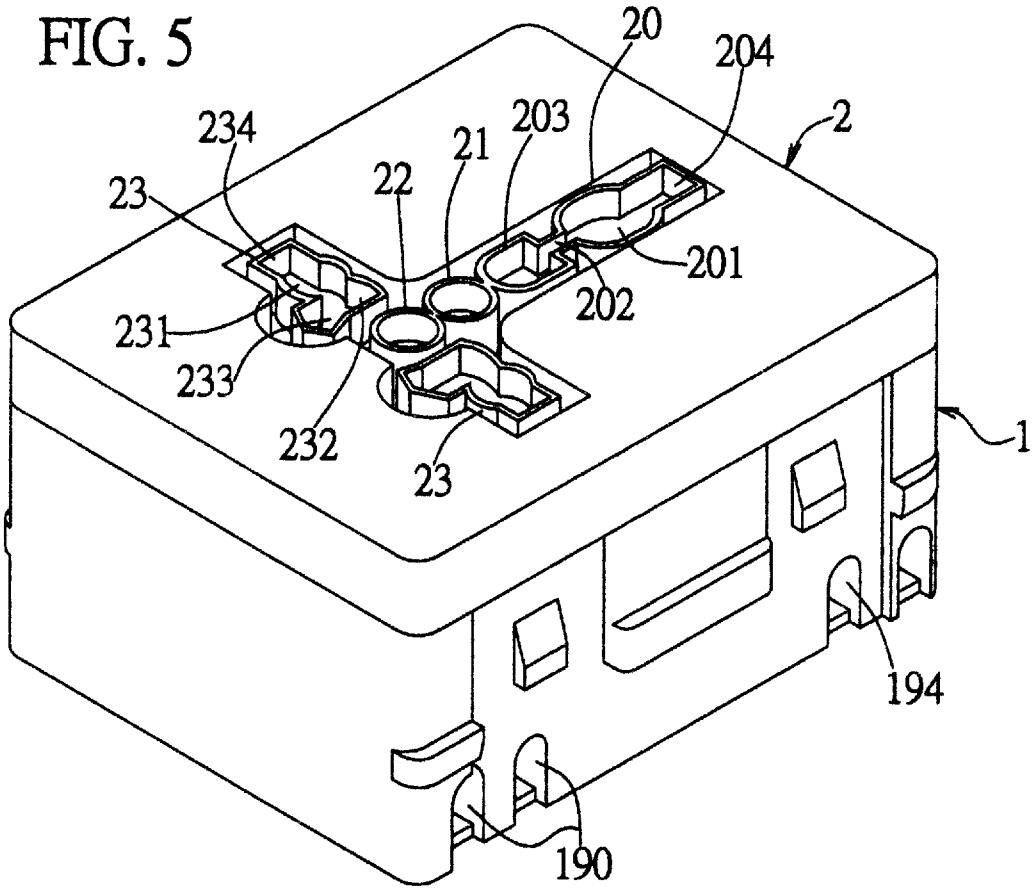
FIG. 5 is a perspective view of the electrical outlet device when assembled.

Referring together to FIGS. 2 through 5, there are shown a preferred embodiment of the electrical outlet device according to the present invention. This electrical outlet device includes a base casing 1, a cover 2 covering the top of the base casing 1, a grounding conductive assembly 3, a first contact conductive assembly 4, and a second contact conductive assembly 5.

The base casing 1 has a bottom wall 10 and four side walls 11. A pair of separators 120, 122, and a pair of side plates 130, 132 having separating pieces 140, 142 perpendicularly connected thereto, are used to divide the inside of the base casing 1 into several compartments, including a ground compartment 15 between the separators 120, 122, a first contact compartment 16 between the separator 120 and the side plate 130 within the separating pieces 140, and a second contact compartment 17 between the separator 122 and the side plate 132 within the separating pieces 142. The bottom wall 10 is formed with screw holes 180, 182, 184 and correspondingly the side walls 11 are formed with matching slots 190, 192 and 194.

The cover 2 is formed with a substantially T-shaped opening, in which a first ground slot 20, a second ground slot 21, and a third ground slot 22 and a pair of receptacle slots 23 positioned symmetrically about the third ground slot 22 are formed. The first ground slot 20 is basically an elongated slot including a first portion 201 which is substantially circular in shape, a second portion 202 which is also circular in shape, a third portion 203 which connects the first portion 201 and second portion 202, and a fourth portion 204 which is substantially rectangular in shape and connected to the first portion 201. The second ground slot 21 and the third ground slot 22 are both circular in shape. These three slots 20, 21, 22 can receive plugs having round and flat plug pins. Further, the receptacle slots 23 each includes a first portion 231 which is basically circular in shape, a second portion 232 which is basically rectangular in shape and connected to one side of the first portion 231, a third portion 233 connected in a slanted direction to the second portion 232, and a fourth portion 234 which is also basically rectangular in shape and connected to the other side of the first portion 231. Among these portions, the third portion 233 is specifically used to receive plugs having slanted plug pins.

The grounding conductive assembly 3 includes a base frame 30 which is integrally formed with a first clamping portion 31, a second clamping portion 32, and a third clamping portion 33 thereon. The first clamping portion 31 is composed of a first pair of elastic pieces 310, 312; the second clamping portion 32 is composed of a second pair of elastic pieces 320, 322; and the thirds clamping portion 33 is composed of a third pair of elastic pieces 330, 332. Further, the first pair of elastic pieces 310, 312 and third pair of elastic pieces 330, 332 are formed with notches 3100, 3102 and 3300, 3302 which divide the top end of each of these elastic pieces into two wing pieces, respectively (3110, 3112), (3120, 3122), (3310, 3312), and (3320, 3322). These wing pieces are each bent into a curved shape. The second pair of elastic pieces 320, 322 are formed with downward extending wings pieces 3200, 3202 which are first bent inwards toward each other and then bent outwards in the middle. Further, a fastening piece 34 having a screw hole 340 is integrally formed below the elastic pieces 312 near the bottom of the base frame 30.

The first and second contact conductive assemblies 4, 5 have the same configurations. The first contact conductive assembly 4 includes a base frame 40 having a side wall 41 formed thereon, a screen elastic piece 42 integrally formed on the top of the side wall 41, and a rib-like clamping portion 43 integrally formed on the base frame 40. Similarly, the second contact conductive assembly 5 includes a base frame 50 having a side wall 51 formed thereon, a screen elastic piece 52 integrally formed on the top of the side wall 51, and a rib-like clamping portion 53 integrally formed on the base frame 50. Further, notches 440, 442 and 540, 542 are formed on the top edges of the elastic pieces 42, 52. By design, side portions 450, 452 are thus respectively formed between the side edges of the screen elastic piece 42 and notches 440, 442 and are bent away from the clamping portion 43. Likewise, side portions 550, 552 are thus respectively formed between the side edges of the screen electric piece 52 and notches 540, 542 and are bent away from the clamping portion 53. The clamping portion 43 is composed of a pair of elastic pieces 430, 432, and similarly the clamping portion 53 is composed of a pair of elastic pieces 530, 532. Notches 4300, 4302 and 5300, 5302 are formed on the top edges of these elastic pieces 430, 432 and 530, 532. Further, elastic pieces 430, 432 and 530, 532 are bent into curved shape and, the top edges of the elastic pieces 430, 432 and 530, 532 are further outwardly folded. In addition, the first and second contact conductive assemblies 4, 5 are provided with fastening pieces 46, 56 having screw holes 460, 560 for securing the first and second contact conductive assemblies 4, 5 to the base casing 1.

When assembling the electrical outlet device, screws 60, 62, 64 with washers 70, 72, 74 are screwed into the corresponding screw holes 340, 460, 560. Then the grounding conductive assembly 3 is securely mounted in the ground compartment 15 in the base casing 1; and the first and second contact conductive assemblies 4, 5 are securely mounted respectively in the first and second contact compartments 16, 17. The cover 2 is then secured to the top of the base casing 1 by means of, for example, high-frequency soldering, a sealant, or screws. Further, wires 80, 82, 84 are inserted through the matching slots 190, 192, 194 in the side walls 11 into the inside of the base casing 1. The ends of these wires 80, 82, 84 are respectively placed between the fastening pieces 34, 46, 56 and the washers 70, 72, 74, and then fastened between the same by screws 60, 62, 64. It thus completes the assembly of the electrical outlet device. Further, since the heads 600, 602, 604 of the screw 60, 62, 64 are greater in diameter than the screw holes 180, 182, 184, the screw 60, 62, 64 can be prevented from falling out of the screw holes 180, 182, 184.

Figure 6:
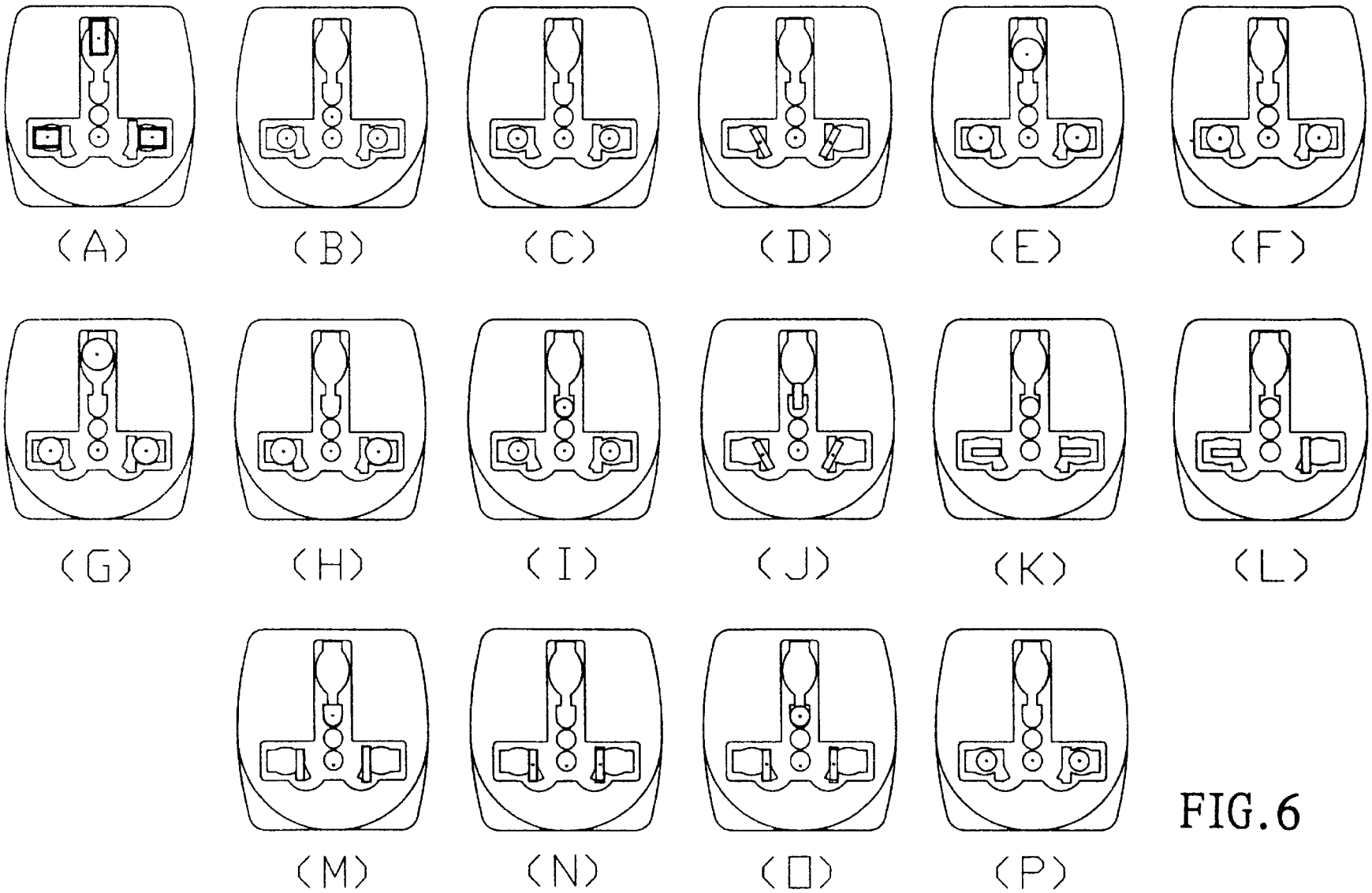
FIG. 6A to 6P are schematic diagrams showing a number of receptacle configurations of the electrical outlet device according to the present invention for connection with a variety of plugs.

In use, when a plug having large round plug pins is to be connected with the electrical outlet device of the invention, the plug pins will be clamped between the clamping portions 43, 53 in the first and second contact conductive assemblies 4, 5, as illustrated in FIG. 6E and 6F. Due to the provision of notches 430, 530 on the elastic pieces 430, 432 and 530, 532 of these clamping portions 43, 53, the flexibility of the elastic pieces 430, 432 and 530, 532 will be increased such that the resistance against the blades by the clamping portions 43, 53 will be reduced. Therefore, after alternate uses between large-pin and small-pin plugs, the clamping portions 43, 53 would hardly be subjected to elastic fatigue that causes poor electrical contacts between the plug and receptacle. This is the same for plugs having various sies of flat pins.

When using the Australian type plugs having slant plug pins, as shown in FIG. 6D and FIG 6J, the bottom ends of the plug pins can be inserted into and snugly fitted in the third portion 233 in the receptacle slot 23. The problem of rubbing against the wall of the receptacle slot by the slanted plug pins as in the prior art is eliminated. Further, when the slanted plug pins are inserted into the first and second contact conductive assemblies 4, 5, they will come into a tight surface-to-surface contact with the side portions 450, 452 and 550, 552 due to the angled arrangement of the side portions 450, 452 and 550, 552 with respect to the screen elastic pieces 42, 52. This solves the problem of point-to-point contacts between the plug pins and the conductive pieces in the receptacle which causes poor electrical contact in the prior art.

Furthermore, the curved designs for the wing pieces 3120, 3122, 3310, 3312, 3320, 3322, the elastic pieces 430, 432 and 530, 532 allow the plugs having round plug pins to come into a tight surface-to-surface contact therewith. The electrical contact is therefore good. In addition, the bent shape of the wing pieces 3200, 3202 of the elastic pieces 320, 322 allow the plug to be unplugged from the receptacle without causing heavy abrasion by the wing pieces 3200, 3202 to the plug pins. The withdrawal is therefore smooth.

Since the first and second contact conductive assemblies 4, 5 are identical in structure, only one model is needed. The assembly and component control are therefore easier to carry out.

The invention has been described using exemplary preferred embodiments. However, it is to be understood that the scope of the invention is not limited to the disclosed embodiments. To the contrary, it is intended to cover various modifications and similar arrangements. The scope of the claims, therefore, should be accorded the broadest interpretation so as to encompass all such modifications and similar arrangements.

What is claimed is:

1. An electrical outlet device for connection with various types of plugs, comprising:

a base casing;

a cover covering said base casing;

a grounding conductive assembly including a base frame formed with at least a first clamping portion having a pair of elastic pieces, a second clamping portion having a pair of elastic pieces, and a third clamping portion having a pair of elastic pieces thereon;

a first contact conductive assembly and a second contact conductive assembly, each including a rib clamping portion composing a pair of elastic pieces and a third elastic piece;

wherein said elastic pieces of said first and third clamping portions of said grounding conductive assembly each have a top edge formed with a notch; and said elastic pieces of said rib clamping portion on said first and second contact conductive assemblies each have a top edge formed with a notch, said third elastic piece being bent away from said rib clamping portion.

2. The electrical outlet device of claim 1, wherein said cover is formed with a substantially T-shaped opening in which a first ground slot, a second ground slot, a third ground slot, and a pair of receptacle slots are formed, said receptacle slots having a circular portion specifically used to receive plugs having round plug pins.

3. The electrical outlet device of claim 1, wherein said first and second contact conductive assemblies are identical in structure.

4. The electrical outlet device of claim 1, wherein said elastic pieces of said first and third clamping portions of said grounding conductive assembly are bent toward each other into a curved shape.

5. The electrical outlet device of claim 1, wherein said elastic pieces of said rib clamping portions of said first and second contact conductive assemblies are bent toward each other into a curved shape.

6. The electrical outlet device of claim 1, wherein each of said elastic pieces of said second clamping portion are connected to a piece extending inward and then bending outward to a free end of said piece.

7. The electrical outlet device of claim 1, wherein said third elastic piece is further formed on the top edge with at least two notches.

8. The electrical outlet device of claim 1, wherein each of said elastic pieces of said first clamping portion of said grounding conductive assembly have an outwardly curved piece extending towards said second clamping portion of said grounding conductive assembly.

9. The electrical outlet device of claim 1, wherein each of said elastic pieces of said third clamping portion of said grounding conductive assembly have two outwardly curved members extending upward, one on each side of said notch of said third clamping portion of said grounding conductive assembly.

10. The electrical outlet device of claim 1, wherein said grounding conductive assembly, said first contact conductive assembly, and said second contact conductive assembly each have a fastening piece extending from a base frame, each of said fastening pieces having a screw hole passing therethrough for receiving a screw.

11. The electrical outlet device of claim 1, wherein each pair of elastic pieces of said first clamping portion, said second clamping portion, said third clamping portion, said first contact conductive assembly, and said second contact conductive assembly have said elastic pieces running roughly parallel to each other.

12. The electrical outlet device of claim 1, wherein said third elastic piece is substantially perpendicular to said pair of elastic pieces of said first and second contact conductive assemblies.

* * * * *